United States Patent [19]

Coleman

[11] 4,437,238

[45] Mar. 20, 1984

[54] TOOL FOR SEVERING LEAD CANING

[76] Inventor: John P. Coleman, 5920 Georgia Ave., N.W., Washington, D.C. 20010

[21] Appl. No.: 352,055

[22] Filed: Feb. 24, 1982

[51] Int. Cl.[3] ..... B26B 7/00

[52] U.S. Cl. ..... 30/272 A; 30/315

[58] Field of Search ..... 30/272 R, 272 A, 210, 30/340, 125

[56] References Cited

U.S. PATENT DOCUMENTS

| | | | |
|---|---|---|---|
| 3,009,246 | 11/1961 | Witherby | 30/272 R |
| 3,052,981 | 9/1962 | Landes | 30/272 A |
| 3,353,573 | 11/1967 | Hitzeroth | 30/125 |
| 3,357,101 | 12/1967 | Davis | 30/210 |
| 3,664,021 | 5/1972 | Sawyer | 30/272 A |
| 4,215,475 | 8/1980 | Morford | 30/272 A |
| 4,249,312 | 2/1981 | Christy | 30/340 X |

*Primary Examiner*—Jimmy C. Peters

*Attorney, Agent, or Firm*—Brady, O'Boyle & Gates

[57] ABSTRACT

A hand-held lightweight power tool particularly for severing lead caning used in the making of stained glass work is disclosed. The tool embodies a vibrator which produces rapid angular oscillation of a shaft on its longitudinal axis, the leading end of the shaft carrying a severing blade whose cutting edge is across the axis of the shaft. The amplitude of vibration of the blade can be varied.

11 Claims, 7 Drawing Figures

FIG. 1
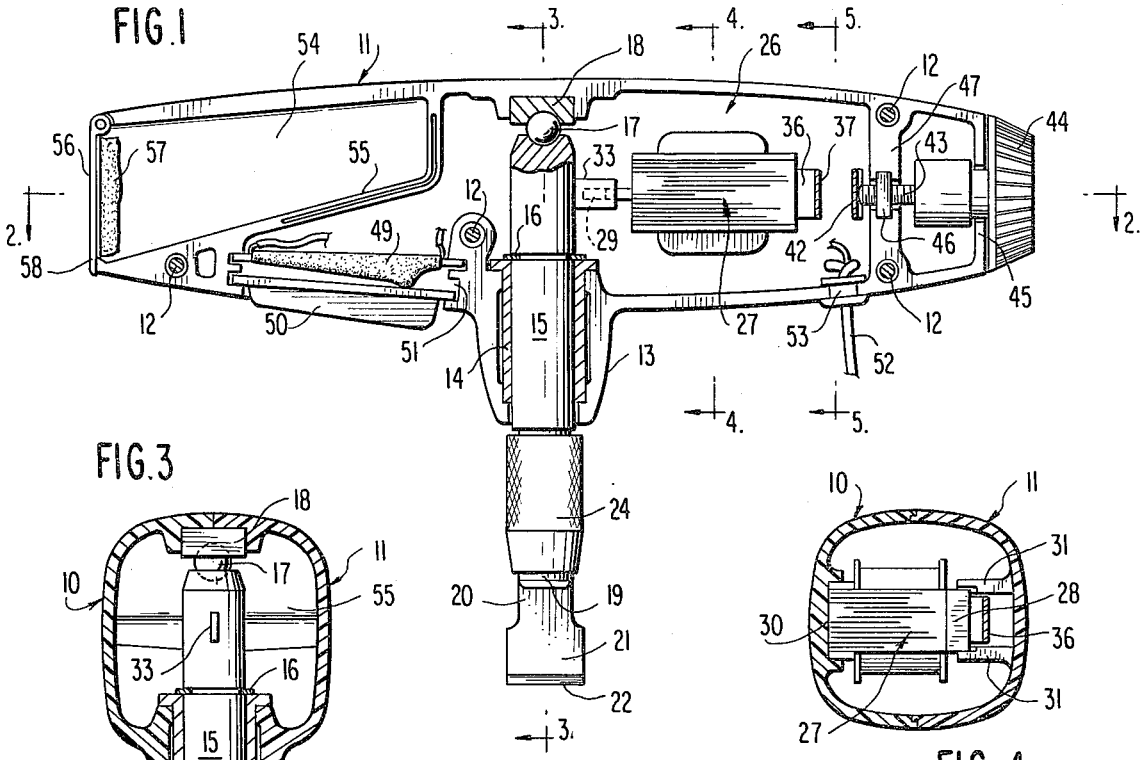
FIG. 3
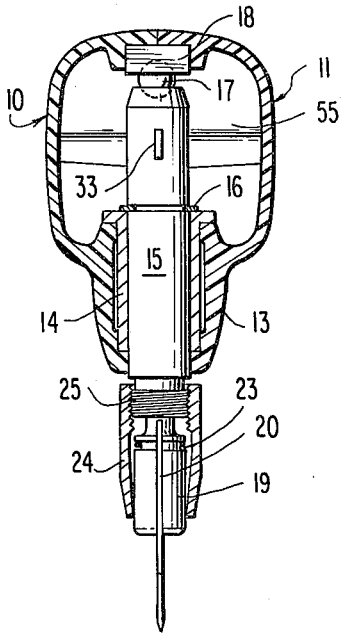
FIG. 4
FIG. 6
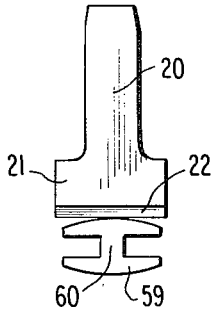
FIG. 5
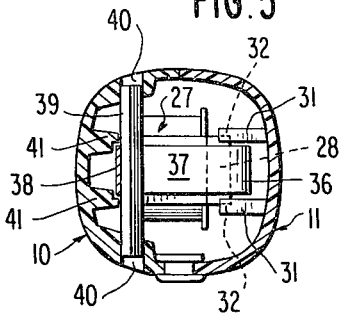
FIG. 7
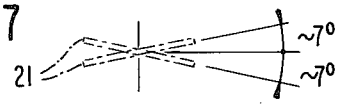
FIG. 2
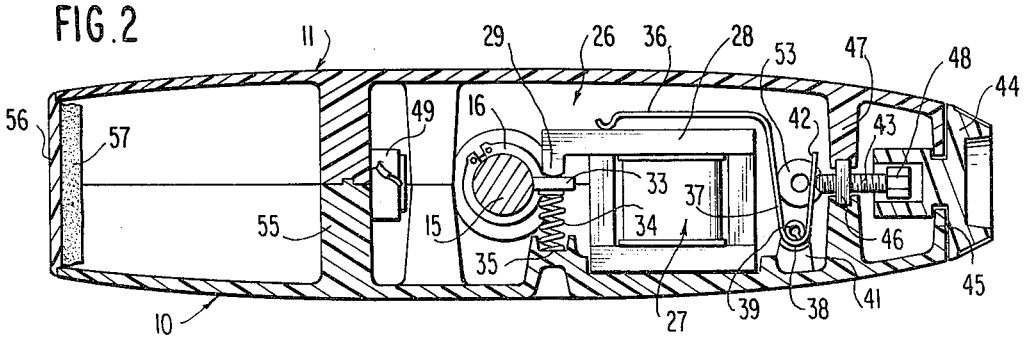

TOOL FOR SEVERING LEAD CANING

BACKGROUND OF THE INVENTION

The crosscutting of lead caning used in producing stained glass work has presented a problem which heretofore has not been satisfactorily solved. The lead caning which has an I-cross section tends to have its center web or heart bent or crushed by the severing blade. This is true when a manual or power vibrated blade having a sawing action is used, and it is true when a longitudinally vibrating blade delivers rapid impacts across the longitudinal axis of the cane. Accordingly, the simple objective of the present invention is to provide a severing tool for lead caning which will cleanly cut through the caning without crushing or otherwise distorting its center web, thus avoiding inconvenient and time-consuming follow-up work in attempting to straighten out the crushed web or heart of the cane.

Great success in solving the above problem is achieved in the invention by employing a power-operated blade which vibrates or oscillates in rotation around the longitudinal axis of the blade shank and the shaft to which the blade is secured, the forward cutting edge of the oscillating blade being across and preferably at right angles to the axis of oscillation. The oscillating blade embodied in the invention is conveniently held in a housing or body which also extends across the axis of the blade and its oscillating shaft to form a substantially T-shaped lightweight power tool conveniently held in one hand. Means are provided to adjust the amplitude of oscillation of the blade.

Other features and advantages of the invention will become apparent to those skilled in the art during the course of the following detailed description.

BRIEF DESCRIPTION OF THE DRAWINGS

FIG. 1 is a central vertical section through a power tool for severing lead caning, parts in elevation, according to the present invention.

FIG. 2 is a horizontal section taken on line 2—2 of FIG. 1.

FIG. 3 is a vertical section taken on line 3—3 of FIG. 1.

FIG. 4 is a vertical section taken on line 4—4 of FIG. 1.

FIG. 5 is a similar section taken on line 5—5 of FIG. 1.

FIG. 6 is a side elevation of an oscillating blade in relation to lead caning being severed.

FIG. 7 is a diagrammatic view illustrating the amplitude of oscillation of the blade.

DETAILED DESCRIPTION

Referring to the drawings in detail wherein like numerals designate like parts, a hand-held lightweight tool for severing lead caning or the like comprises an elongated housing formed in two opposing half sections 10 and 11 preferably formed of plastics material. The housing sections are secured in assembled relationship by screws 12 engaged with nuts, not shown, preferably molded in the housing body.

Near its longitudinal center on one side thereof the housing includes a short extension 13 whose axis is perpendicular to the longitudinal axis of the housing. Held within this extension 13 is a bushing 14 which serves to journal a shaft 15 which is oscillated rapidly around its longitudinal axis in the operation of the tool, as will be further described. At the inner end of bushing 14, the shaft 15 is retained in the extension 13 by a spring retainer ring 16 seated in a groove of the shaft. The interior end of shaft 15 extends into and substantially across the housing 10–11 and at its inner end engages a captive ball thrust bearing 17 which in turn rests on a captive seat or block element 18.

The shaft 15 extends forwardly of the extension 13 and includes a divided forward end portion 19 receiving the shank 20 of a relatively narrow blade 21 whose forward cutting edge 22 is normal to the axis of shaft 15. The shank 20 is held in the divided forward end portion 19 by a light constrictive ring 23 prior to tightening a tapered adjustable chuck sleeve 24 onto the divided end portion 19, the chuck sleeve having screw-threaded engagement with threads 25 on the shaft 15. The blade holding chuck structure is conventional.

The divided housing 10–11 includes a main chamber 26 within which is held an electrical vibrator unit 27 having an armature plate 28 including a rigid shaft actuator extension 29 at the interior end of the vibrator. As shown in FIG. 4, the vibrator body is held in a recess 30 of housing half 10 and the armature plate 28 is held loosely between lugs 31 of the opposing housing half 11, which lugs allow the armature plate to vibrate but restrain it against vertical movement as viewed in FIG. 4. As best shown in FIG. 5, the lugs 31 at 32 also restrain or prevent movement of the armature plate 28 longitudinally of the housing 10–11.

Vibration of the armature plate 28 imparts angular oscillation to the shaft 15 through engagement of a radial lug 33 on the shaft near its interior end with the actuator extension 29 of the vibrator armature plate. The lug 33 is opposed by a compression spring 34 held in an internal seat 35 of housing half 10.

The vibrating armature plate 28 is engaged on its outer side by a stiff leaf spring 36 which works in opposition to the spring 34. The leaf spring 36 includes a lateral bifurcated extension 37 at the outer end of the vibrator unit having its bight 38 anchored by a roll pin 39 whose opposite ends are secured in openings 40, FIG. 5, of housing half 10. Spaced lugs 41 on housing half 10 also engage and support the bight 38 in conjunction with the roll pin 39, FIG. 2, and these lugs restrain the spring extension 37 from lateral displacement across the housing, as best shown in FIG. 5.

The free arm 42 of the bifurcated spring extension is engaged by a threaded adjusting screw 43 secured to an adjusting knob 44 rotatably connected with the housing end wall 45. The adjusting screw 43 engages a captive nut 46 held in an internal cross web 47 of the divided housing 10–11. The head 48 of screw 43 is coupled in a lost motion cavity in the knob 44 to turn therewith, and the head 48 moves longitudinally in the cavity as the knob 44 is turned. The tension of leaf spring 36 acting on armature plate 28 can be increased or decreased within limits by turning the adjusting knob 44. This, in turn, regulates the amplitude of oscillation of severing blade 21 around the axis of shaft 15. Typically, as shown in FIG. 7, a 1/32 inch movement of armature plate 28 applied to the shaft 15 at a ¼ inch radius will result in a total amplitude of oscillation of the blade 21 of about 14°, or 7° on either side of a median plane.

The vibrator unit 27 is turned off and on by a sealed captive switch 49 in the housing operated by a captive actuator button 50 capable of restrained movement at its forward end in a recess 51 sufficient to operate the switch. A suitable power cable 52 enters the housing 10–11 through a grommet 53. Wiring of the switch 49 to the vibrator is conventional.

At its end away from the knob 44, the housing 10–11 has a spare blade compartment 54 defined by an internal wall 55 and having a hinged end access door 56 padded at 57. The compartment 54 can hold several of the blades 21. The door 56 has a snap closure detent 58, as shown.

The housing 10–11 is shaped and sized to fit conveniently and comfortably in one hand of a user of the severing tool, with the user's fingers positioned on opposite sides of the extension 13, and with at least one finger engaged over the actuator button 50. The overall configuration of the lightweight tool is approximately T-shaped for further convenience of usage. The cutting edge 22 of the blade 21 is brought to bear on the I-cross section lead caning 59, as shown in FIG. 6, and when the vibrator is turned on, the rapid oscillation of the blade on the longitudinal axis of shaft 15, combined with light band pressure, will cause the blade to cut cleanly through the caning without crushing or deforming its internal web 60, in accordance with the main objective of the invention. Additionally, the top and bottom webs of the caning will also not be deformed or crushed and there will be no discernable beading up of the lead on opposite sides of the cut.

While the inventive tool has been described in relation to the cutting of lead caning, it is to be understood that this tool can be used for cutting other items that are capable of being cut with a blade and which are readily distorted or deformed to a damaged state when cut or severed by normal cutting means.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A tool for severing lead canning and the like comprising a body portion forming a handle, a shaft journaled on the body portion and projecting therefrom substantially normal to the axis of said body portion, power means operatively coupled with the shaft causing it to oscillate rapidly around the longitudinal axis of the shaft, and a blade fixed to the leading end of the shaft and having a leading cutting edge extending at right angles to and on opposite sides across the axis of oscillation of the shaft, whereby downward pressure on said handle is transmitted axially along the longitudinal axis of said shaft and axially to said leading cutting edge during the cutting operation.

2. A tool for severing lead caning as defined in claim 1, and the body portion comprising a housing and the power means comprising an electrical vibrator in the housing, said shaft extending into the housing.

3. A tool for severing lead canning as defined in claim 2, and said tool defined by the housing, shaft and blade being substantially T-shaped, the housing having opposite end portions on its axis on opposite sides of said shaft and being shaped and sized for convenient holding in one hand by a user with the user's fingers positioned on opposite sides of the shaft.

4. A tool for severing lead caning as defined in claim 2, and manually operated means on the housing to adjust the amplitude of oscillation of the shaft and blade under influence of the vibrator.

5. A tool for severing lead caning as defined in claim 4, and the manually operated means comprising a spring within the housing bearing on the armature of said vibrator, and a spring tension adjuster on the housing connected with said spring.

6. A tool for severing lead caning as defined in claim 5, and the spring tension adjuster comprising a tension adjusting screw connected with said spring, and a rotary knob on one end of the housing coupled with said screw to turn it.

7. A tool for severing lead caning as defined in claim 2, and a radial drive lug on said shaft, and said vibrator having an armature element engaging one side of the drive lug, and a spring engaging the opposite side of the drive lug to resist the force of the armature element.

8. A tool for severing lead caning as defined in claim 3, and said housing having a spare blade compartment in one of said opposite end portions thereof on one side of said shaft, and a manual adjuster on the other end of said housing connected with the vibrator to vary the amplitude of oscillation of the shaft.

9. A tool for severing lead caning as defined in claim 8, and an on-off switch and switch actuator for the electrical vibrator on said housing.

10. A tool for severing lead caning as defined in claim 1, and a releasable chuck means coupling said blade to the leading end of said shaft detachably.

11. A tool for severing lead canning and the like comprising a housing forming a handle, a shaft journaled on the housing and projecting therefrom at a medial portion and at substantially right angles to the axis of said housing, an electrical vibrator in said housing operatively coupled with said shaft causing it to oscillate rapidly around the longitudinal axis of the shaft, a blade fixed to the leading end of the shaft and having a leading cutting edge extending across and on opposite sides of and at right angles to the axis of oscillation of the shaft, said tool defined by the housing, shaft and blade being substantially T-shaped, said shaft having a free end inside said housing, the housing being shaped and sized for convenient holding in one hand by a user with the user's fingers positioned on opposite sides of the shaft, and a thrust bearing interposed between the free end of said shaft and said housing to transmit pressure axially from the user's hand to said leading cutting edge through said shaft.

* * * * *